US005450807A

United States Patent [19]

Moody

[11] Patent Number: 5,450,807

[45] Date of Patent: Sep. 19, 1995

[54] SHUTTER DOOR ASSEMBLY

[75] Inventor: Paul E. Moody, Barrington, R.I.

[73] Assignee: The United States of America as represented by the Secretary of the Navy, Washington, D.C.

[21] Appl. No.: 304,334

[22] Filed: Sep. 12, 1994

[51] Int. Cl.[6] ..... B63B 19/18

[52] U.S. Cl. ..... 114/202; 114/320

[58] Field of Search ..... 114/202, 238, 316, 318, 114/319, 320

[56] References Cited

U.S. PATENT DOCUMENTS 3,151,663 10/1964 Bohner et al. ..... 114/202

FOREIGN PATENT DOCUMENTS 580721 9/1946 United Kingdom ..... 114/238

*Primary Examiner*—Jesus D. Sotelo

*Attorney, Agent, or Firm*—Michael J. McGowan; James M. Kasischke; Prithvi C. Lall

[57] ABSTRACT

A torpedo tube shutter door assembly includes a series of segmented, abutting panels constituting a shutter door for selectively blocking an elongate opening formed in an outer hull of a submarine. The panels are movable between a closed position in which the panels fair to the outer hull and block the opening, and an open position in which the panels slidably move away from the opening along a longitudinal axis. Links connect the panels together and a guide mechanism guides the sliding movement of the panels between their closed and open positions. A drive actuates sliding movement of the panels between closed and open positions.

12 Claims, 4 Drawing Sheets

SHUTTER DOOR ASSEMBLY

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

This invention relates generally to submersible vessels and more particularly to a torpedo tube shutter door assembly.

(2) Description of the Prior Art

Submarines utilize a torpedo tube shutter door to fair the outer hull in the area where a weapon is launched from the vessel. Presently, there are primarily two shutter door configurations, a rotating shutter and a hinged shutter. In both arrangements, the torpedo tubes penetrate the vessel's pressure (inner) hull and a guide can guides the weapon as it travels out of the torpedo tube towards the outer hull and out to sea. The closable shutter door is provided to continue the egress path as the weapon travels from the vessel to the open sea.

A rotatable shutter is cone-shaped and rotates about an axis that is offset from the torpedo tube axis. In an open position, an opening in the large end of the shutter aligns a shutter inner guide surface with the torpedo tube axis in order to provide a clear path for the weapon. When the shutter is rotated to its closed position, the inner side of the shutter rotates to the outboard side of the vessel to provide a fairing with the outer hull. Since the rotatable shutter is cone-shaped, it occupies a great amount of space which otherwise could be utilized for other purposes.

The other type of shutter, the hinged shutter, is hinged at its forward end in a manner very similar to a standard door. The hinged shutter door is operated by a mechanism which utilizes a linkage system to open and close the shutter door. Like the rotatable shutter, this linkage system also occupies a great amount of space.

A problem associated with both of these shutter door arrangements is that the doors are very large (i.e., approximately fifteen feet long) because of the complex angle in which the torpedo tube axis intersects the outer hull. Also, the doors can only be supported at a limited number of points due to the enormity of their designs and the limited amount of space between the outer and inner hulls. There is presently a need for a shutter door assembly which is both compact and strong.

SUMMARY OF THE INVENTION

The instant invention provides an improved torpedo tube shutter door assembly.

Among the several objects of the present invention are the provision of a torpedo tube shutter door assembly which occupies a lesser amount of space than previous shutter doors; the provision of such a shutter door assembly which is resistant to forces resulting from hydrodynamic flow; and the provision of such a shutter door assembly which is simple in design and easy to manufacture and assemble.

In general, the invention is directed to an improved shutter door assembly comprising a series of segmented, abutting panels constituting a shutter door for selectively blocking an elongate opening formed in the outer hull. The panels are movable between a closed position in which the panels fair to the outer hull and block the opening, and an open position in which the panels slidably move away from the opening along a longitudinal axis. Link means connect the panels together and guide means guide the sliding movement of the panels between their closed and open positions. A drive powers the sliding movement of the panels between their closed and open positions.

BRIEF DESCRIPTION OF THE DRAWINGS

A more complete understanding of the invention and many of the attendant advantages thereto will be readily appreciated as the same become better understood by reference to the following detailed description when considered in conjunction with the accompanying drawings wherein.

Corresponding references designate corresponding parts throughout the several views of the drawings.

DETAILED DESCRIPTION OF THE PREFERRED EMBODIMENT

Figure 1:
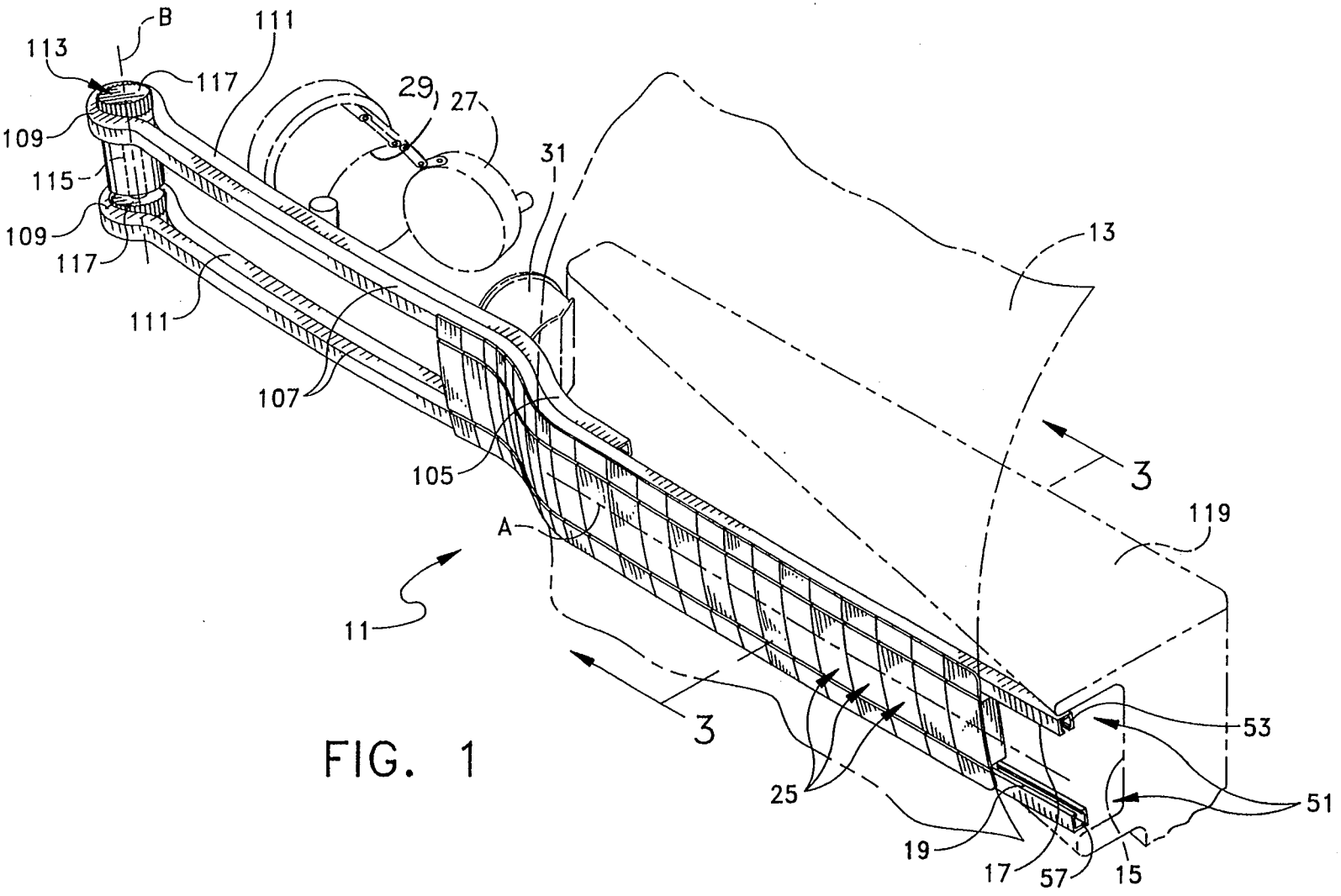
FIG. 1 is a top perspective view with portions removed to reveal a torpedo tube shutter door of the present invention.
Figure 2:
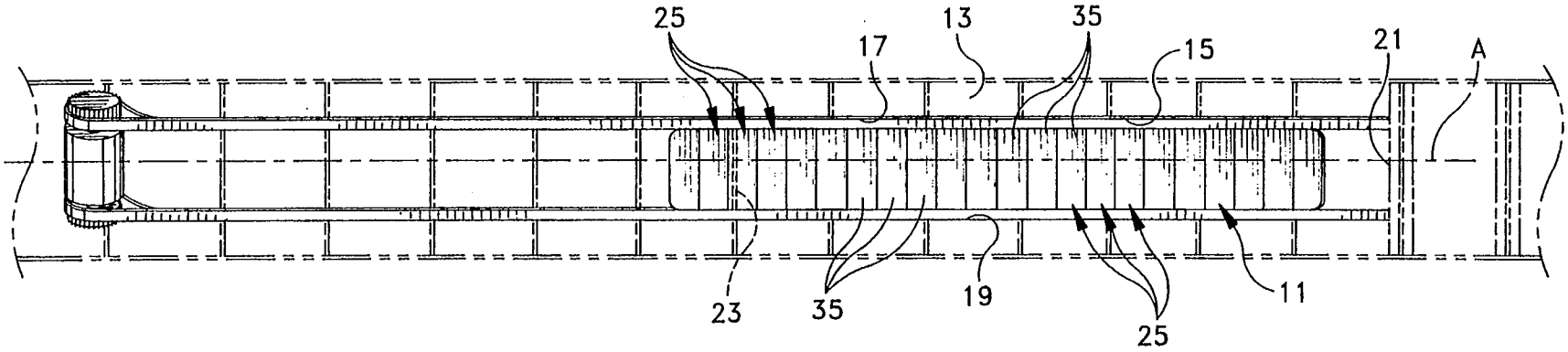
FIG. 2 is an elevation view thereof.

Referring generally to the drawings, and more particularly to FIGS. 1 and 2, there is generally indicated at 11 a shutter door assembly for a submersible vessel (i.e., a submarine) having an outer hull 13 with an elongate opening 15 formed therein. Opening 15 is generally rectangular and extends in the forward and aft direction along a generally horizontal, longitudinal axis A, the opening 15 having two long sides 17, 19 and two relatively short ends 21, 23. Shutter door assembly 11 comprises a series of segmented, abutting panels, each generally designated 25, which together constitute a shutter door. Panels 25 are movable between a closed position in which the panels 25 fair to the outer hull 13 and block the opening 15, and an open position in which the panels 25 slidably have moved away from the opening 15 in unison along the longitudinal axis A. Panels 25 are necessary to prevent flow turbulence in the flow field of the submarine as it propels itself through the water.

For illustration purposes, only one opening 15 and one shutter door assembly 11 have been illustrated. However, the arrangement is such that two torpedo tubes, one above the other, are provided on each side of the submarine. It is to be understood that the shutter door assembly 11 of the present invention operates independently from the other shutter door assembly for the other torpedo tube.

Prior to firing a torpedo, panels 25 are opened to provide a clear path for the torpedo to be ejected from within the ship. As shown in FIG. 1, a torpedo tube muzzle door 27 is provided for sealing an opening 29 in an inner hull (not shown) of the submarine from which a fired torpedo exits. A guide can 31 guides the torpedo from the opening 29 through the opening 15 in the outer hull 13. It should be noted that the panels 25 do not form a pressure containing door as this function is accomplished by the much stronger pressure sealed torpedo tube muzzle door 27. In addition, there is no pressure seal between the panels 25 and the outer hull 13. Therefore, there are no forces on the panels 25 which are attributable to sea pressure except for hydrodynamic flow over their surfaces which are fairly significant. Thus, panels 25 are designed to be relatively stiff to prevent shutter vibration and deflection caused by the hydrodynamic flow.

Figure 3:
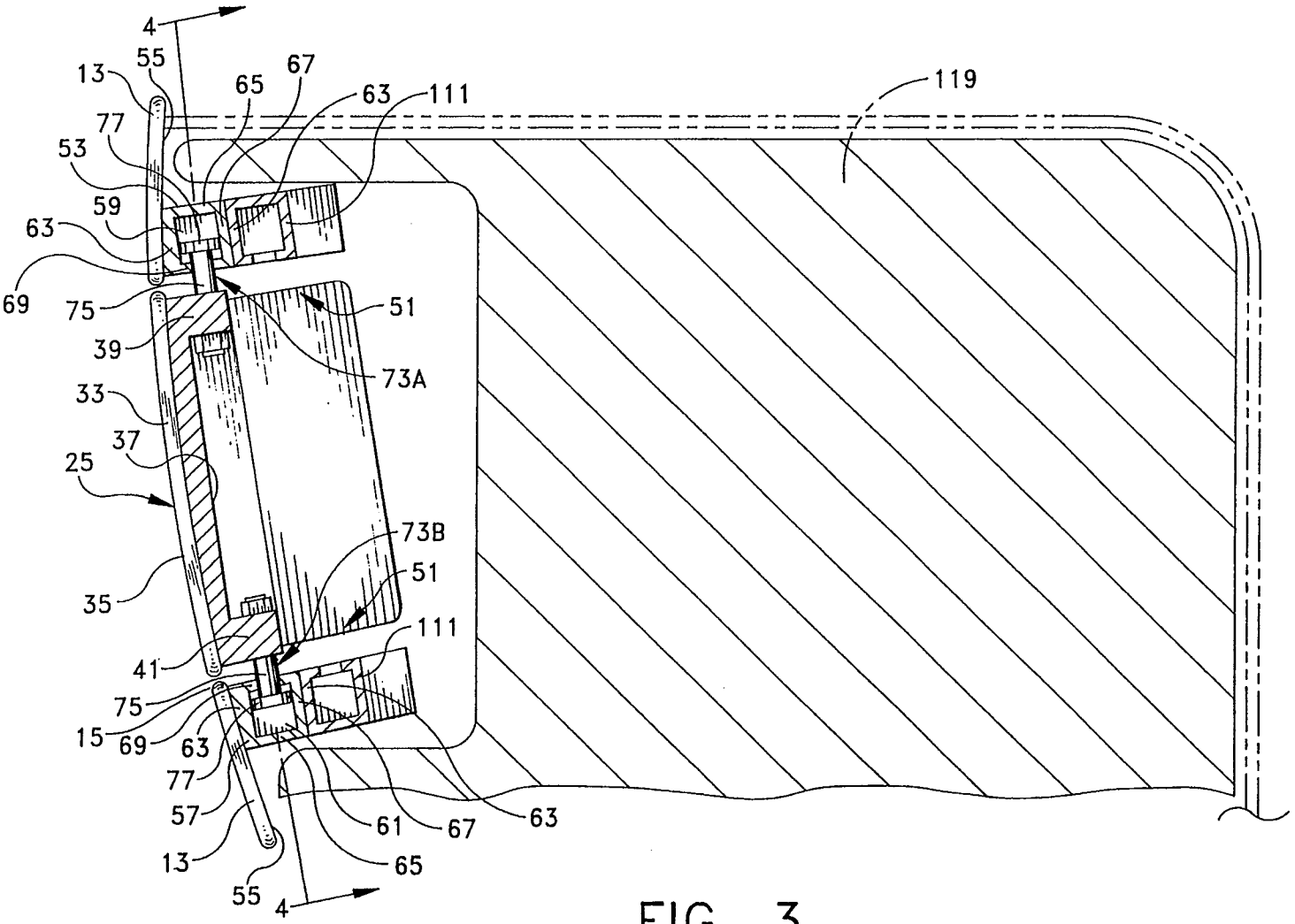
FIG. 3 is a cross-sectional view taken along line 3—3 of FIG. 1.
Figure 4:
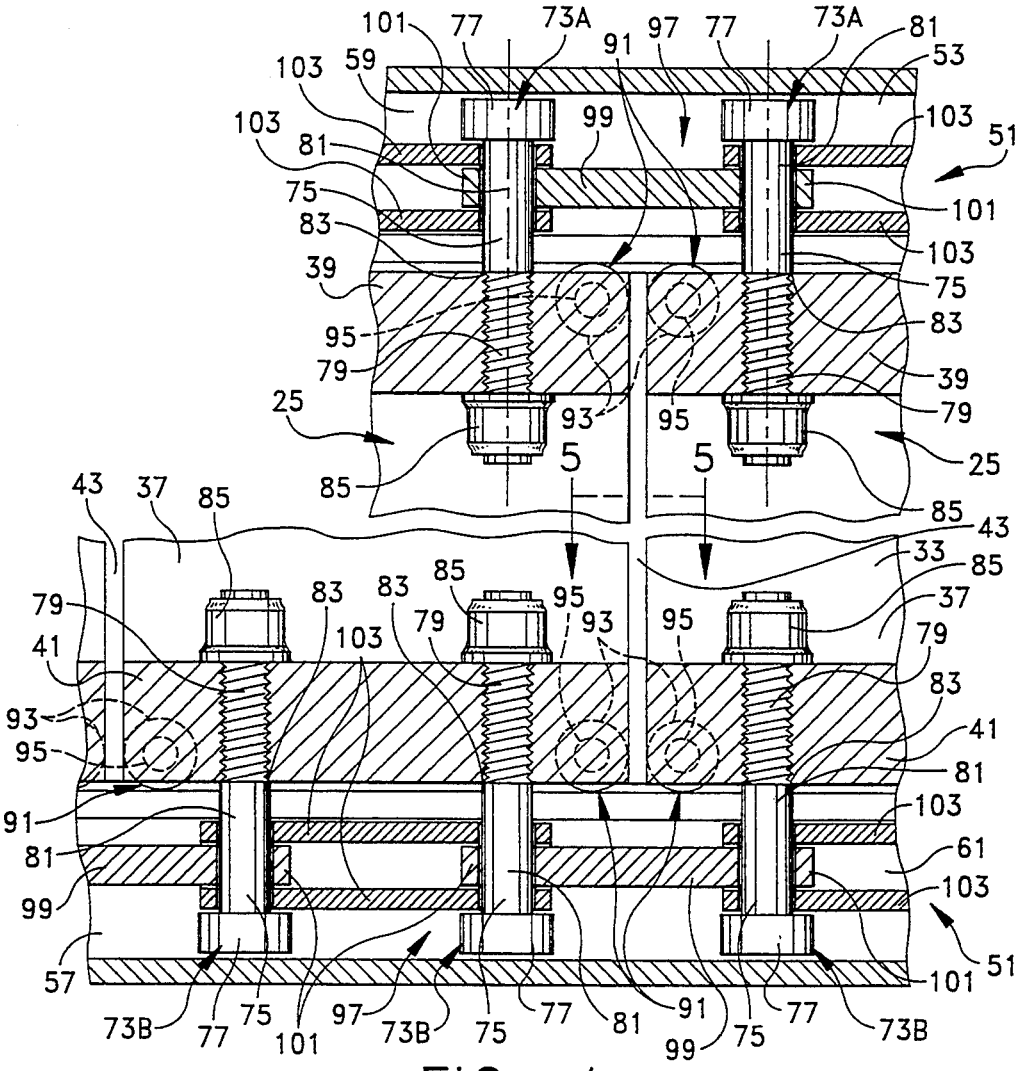
FIG. 4 is a cross-sectional view taken along line 4—4 of FIG. 3.

As illustrated in FIGS. 3 and 4, each panel 25 is preferably fabricated from steel and is generally C-shaped as viewed in cross section. Each panel has a relatively flat wall 33 having an outer surface 35 facing open sea and an inner surface 37 facing inboard. A top flange 39 extends from a top edge of the wall 33 inboard with respect to the wall 33 and a bottom flange 41 extends from a bottom edge of the wall 33 inboard with respect to the wall 33.

Figure 5:
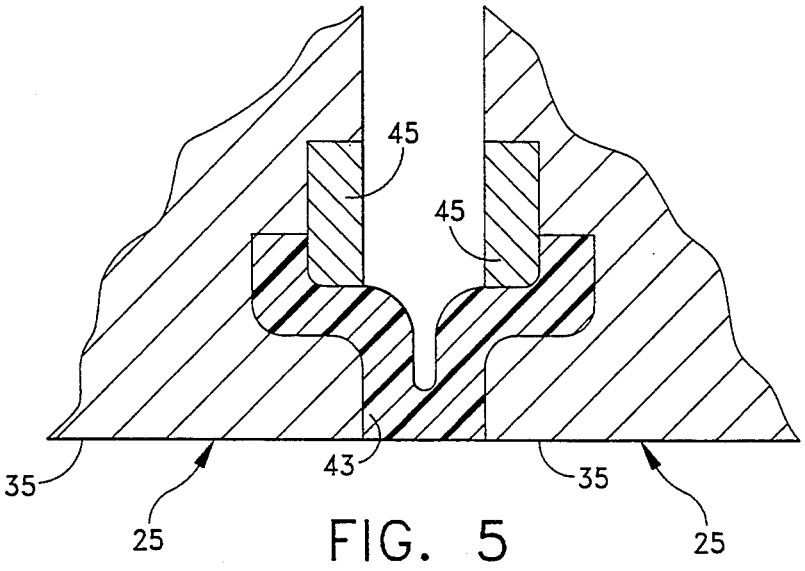
FIG. 5 is an enlarged cross-sectional view taken along line 5—5 of FIG. 4.

As best shown in FIG. 5, an elastomeric gasket 43 is positioned within each gap formed between adjacent panels 25 for providing an uninterrupted flow surface over adjacent panels 25. Gasket 43 may be fabricated from any elastomeric material which is capable of filling the gap between the adjacent panels 25. A retainer 45 is provided for retaining the gasket 43 within oppositely positioned grooves formed along adjacent edges of the panels 25. As shown, the outer surface of the gasket 43 is flush with respect to the outer surfaces 35 of the walls 33, of the panels 25 for maintaining the uninterrupted flow surface.

As illustrated in the drawings, guide means, generally designated 51, is provided for guiding the movement of the panels 25 between their closed and open positions. Guide means 51 comprises an upper track 53 mounted on an inner surface 55 of the outer hull 13 above the opening 15 and a lower track 57 mounted on the inner surface 55 of the outer hull 13 below the opening 15. As illustrated in FIG. 1, upper and lower tracks 53, 57 are adjacent respective upper and lower sides 17, 19 of the opening 15 and extend in the aft direction generally parallel to the longitudinal axis A.

As viewed in FIG. 3, upper track 53 is generally inverted U-shaped in cross-section and comprises a channel indicated at 59. Similarly, lower track 57 is generally U-shaped in cross-section and comprises a channel indicated at 61. Each upper and lower track 53, 57 is identically constructed and comprises (as viewed in FIG. 3) a first side portion 63 mounted on the inner surface 55 of the outer hull 13 (as by welding), a connector portion 65 extending inboard from the upper edge margin of the first side portion 63 for the upper track 53 and from the lower edge margin of the first side portion 63 for the lower track 57, and a second side portion 67 extending downwardly from the connector portion 65 for the upper track 53 and upwardly from the connector portion 65 for the lower track 57. Each upper and lower track 53, 57 also comprises a pair of flanges each indicated as 69, for forming a slot in the respective track 53, 57 which is narrower than the respective channel 59, 61.

Referring to FIG. 4, guide means 51 further comprises, for each panel 25, two upper roller assemblies (each being generally designated 73A) and two lower roller assemblies (each being designated 73B) received in the upper and lower tracks 53, 57, respectively, for rolling movement therein. Each roller assembly 73A, 73B comprises a shaft 75 and a roller 77 rotatably attached to the shaft 75 and received within the channel 59, 61 of its respective track 53, 57. Suitable bearings mount the roller 77 on the shaft 75. The shaft 75 of each upper roller assembly 73 is mounted on the top flange 39 of the panel 25 and extends upwardly through the slot of the track. The roller 77 of each upper roller assembly 73A is captured within the channel 59 of the upper track 53 for rolling movement therein. Similarly, the shaft 75 of each lower roller assembly 73B is mounted on the bottom flange 41 of the panel 25 and extends downwardly through the slot of the track, the roller 77 of each lower roller assembly 73B being captured within the channel 61 of the lower track 57 for rolling movement therein.

As illustrated in FIG. 4, the shaft 75 of each roller assembly 73A, 73B includes a threaded end portion 79, a shoulder portion 81 and a shoulder 83 at the junction of the end portion 79 and the shoulder portion 81. The threaded end portion 79 is threadably received in a threaded bore formed in the flange (39 or 41) of the panel 25 until the shoulder 83 of the shaft 75 abuts the flange. A stop nut 85 threaded onto the outer end of the threaded end portion 79 secures the shaft 75 to the flange. Roller 77 is attached to the outer end of the shoulder portion 81 of the shaft 75, and, as illustrated in FIG. 3, rides at the bottom of its respective channel 59, 61 (i.e., adjacent the connector portion 65 of the track 53, 57). The roller 77 is a chain-type roller preferably fabricated from hard material, such as bronze.

Guiding the movement of the panels 25 through the opening 15 and supporting the weight of each panel are panel roller assemblies each generally indicated 91. As illustrated in FIG. 4, two panel roller assemblies 91 are housed in the top flange 39 of the panel 25 for engagement with the top edge of the opening 15 (the top and bottom edges of the opening 15 being defined by the edge of the opening 15 and the side of the flange 39, 41 of the track 53,57). Similarly, two panel roller assemblies 91 are housed in the bottom flange 41 of the panel 25 for engagement with the bottom edge of the opening 15. Each panel roller assembly 91 comprises two spaced apart rollers 93 (also preferably fabricated from hard material, such as bronze) mounted on a shaft 95, the rollers 93 riding along the edge of the opening 15. Suitable bearings mount the panel rollers 93 on the shaft 95. The panel roller assemblies 91 support the weight of each panel 25 while enabling the panel to move freely within the opening 15 without binding against the edges of the opening.

Link means, generally indicated 97, connects or links adjacent panels 25. Link means 97 comprises a pair of inner links 99, one inner link 99 connecting adjacent shafts 75 of adjacent upper roller assemblies 73A and the other inner link 99 connecting adjacent shafts 75 of adjacent lower roller assemblies 73B. Each inner link 99 includes a lobe 101 at each of its ends having an opening formed therein which is sized for receiving the shoulder portion 83 of the shaft 75 of the roller assembly 73A, 73B therethrough. The links 99 must be of sufficient strength to transfer the movement forces required to slidably move the panels 25 between their closed and opened positions.

A pair of outer links, each indicated 103, stabilize adjacent shafts 75 of the upper and lower roller assemblies 73A, 73B of each panel 25. As shown, each inner link 99 is sandwiched between outer links 103, the outer links 103 being of construction nearly identical the inner link 99 except for its thickness, which is thinner than the inner link 99. The outer links 103 help prevent the shafts 75 of the roller assemblies 73A, 73B from moving laterally when pulled by the inner link 99.

Referring now to FIGS. 1 and 2, upper and lower tracks 53, 57 are mounted on the inner surface 55 of the outer hull 13 such that the panels 25 are flush with the outer hull when in their closed position. At 105, adjacent the aft end 23 of the opening, tracks 53, 57 are sloped inboard from the outer hull 13 so that as each panel 25 is drawn away from the opening 15, and the edge of each panel 25 clears the aft end 23 of the opening 15. This motion is achieved by increasing the thickness of the first side portion 63 of each track 53, 57 which is mounted on the inner surface 55 of the outer hull 13.

Upper and lower tracks 53, 57 each have a first track portion 107 which extends in the aft direction beyond the aft end 23 of the opening 15 along the inner surface 55 of the outer hull 13. At the aft end of the first track portion 107 there is provided a curved track portion 109 which wraps approximately 180° and merges into a second track portion 111 which extends in a forward direction parallel to the first track portion 107 inboard of the first track portion. As illustrated in FIG. 2, second track portion 111 is positively connected to first track portion 107. More specifically, first side portion 63 of the second track portion 111 is joined to the second side portion 67 of the first track portion 107 (see FIG. 3).

At the curved track portion 109 (i.e., the junction between the first and second track portions 107, 111), a drive, generally designated 113, is provided for powering the movement of the panels 25 between their closed and open positions. The drive 113 comprises a rotatable drive shaft 115 driven by a sufficiently sized motor, the shaft 115 extending along an axis B generally perpendicular to the longitudinal axis A and up through the curved track portion 109, and pair of drive sprockets, each designated 117 one for the upper track 53 and one for the lower track 57, mounted on the rotatable drive shaft 115. Each drive sprocket 117 includes teeth (not shown) which extend into the channels 59, 61 of respective upper and lower curved track portions 109 where the rollers 77 of the upper and lower roller assemblies 73A, 73B ride.

When the panels 25 are in their closed position, a pair of chains (not shown), one for each sprocket 117, connects the drive 113 with the aft panel. Chains are encapsulated within track portions 107 and 111 to allow chains to push panels 25 as well as pull them. Upon operating the drive 113, the chains are driven forward through the second track portions 111 while the panels 25 are drawn aft via the first track portions 107. As mentioned above, the slopes of the first track portions 107 are inboard at 105 so that as the panels 25 are drawn aft, they clear the outer hull 13. As the panels 25 are drawn aft, they reach the curved track portions 109 of the upper and lower tracks 53, 57 and the rollers 77 of the upper and lower roller assemblies 73A, 73B are drawn into the upper and lower sprockets 117. The open spaces between adjacent chain links are identical to the spaces between adjacent rollers 77 of the upper and lower roller assemblies 73A, 73B. As the drive shaft 115 rotates the panels 25 about the curved track portions 109 of the upper and lower tracks 53, 57, the outboard edges of the panels 25 will separate from one another due to the curvature of the curved track portions 109. Because the gaskets 43 between adjacent panels 25 are elastomeric, the gaskets 43 temporarily deform for allowing the separation between adjacent panels 25 as they wrap around the curved track portions 109. When the panels 25 return to their closed position, the elastomeric gaskets 43 will return to their prior configuration.

It should be observed that the shutter door assembly 11 of the present invention takes up less space than prior art door assemblies. As illustrated in FIGS. 1 and 3, reference numeral 119 indicates the space saved over the rotating shutter and hinged shutter. This space 119 may be utilized for other purposes.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A torpedo tube shutter door assembly for a submersible vessel having an outer hull with an elongate opening formed therein, said opening extending along a longitudinal axis, said shutter door assembly comprising:

a series of segmented, abutting rigid panels constituting a shutter door for selectively blocking said elongate opening, said panels being movable between a closed position in which the panels fair to the outer hull and block said opening, and an open position in which the panels slidably move away from the opening along said longitudinal axis;

link means connecting said panels together;

guide means in contact with said panels for guiding the sliding movement of said panels between their closed and open positions; and a drive joined mechanically to said panels for powering the sliding movement of the panels between their closed and open positions.

2. A torpedo tube shutter door assembly for a submersible vessel having an outer hull with an elongate opening formed therein, said opening extending along a longitudinal axis, said shutter door assembly comprising:

a series of segmented, abutting panels constituting a shutter door for selectively blocking said elongate opening, said panels being movable between a closed position in which the panels fair to the outer hull and block said opening, and an open position in which the panels slidably move away from the opening along said longitudinal axis;

link means connecting said panels together;

guide means in contact with said panels for guiding the sliding movement of said panels between their closed and open positions:

a drive joined mechanically to said panels for powering the sliding movement of the panels between their closed and open positions; and an elastomeric gasket positioned between adjacent panels, said gasket providing an uninterrupted flow surface over adjacent panels.

3. A torpedo tube shutter door assembly for a submersible vessel having an outer hull with an elongate opening formed therein, said opening extending along a longitudinal axis, said shutter door assembly comprising:

a series of segmented, abutting panels constituting a shutter door for selectively blocking said elongate opening, said panels being movable between a closed position in which the panels fair to the outer hull and block said opening, and an open position in which the panels slidably move away from the opening along said longitudinal axis;

link means connecting said panels together;

guide means in contact with said panels for guiding the sliding movement of said panels between their closed and open positions, said guide means comprising an upper track and a lower track mounted on an inner surface of the outer hull, said upper track being located above said opening and extending in a direction generally parallel to said longitudinal axis and said lower track being located below said opening and extending in a direction generally parallel to said longitudinal axis, and two roller assemblies mounted on each panel, an upper roller assembly being received in the upper track for rolling movement therein, and a lower roller assembly being received in the lower track for rolling movement therein; and a drive joined mechanically to said panels for powering the sliding movement of the panels between their closed and open positions.

4. The shutter door assembly as set forth in claim 3 wherein said upper track is generally of inverted U-shape in cross-section and said lower track is generally U-shape in cross-section, each track having a channel formed therein, and wherein each roller assembly comprises a shaft and a roller rotatably attached to the shaft and receivable within said channel of its respective track.

5. The shutter door assembly as set forth in claim 4 wherein each panel is generally C-shaped in cross section, each panel having a wall which, with the other panels forming said shutter door, blocks said elongate opening, a top flange extending from a top edge of the wall inboard with respect to the wall, and a bottom flange extending from a bottom edge of the wall inboard with respect to the wall.

6. The shutter door assembly as set forth in claim 5 wherein the shaft of the upper roller assembly is mounted on the top flange of the panel and extends upwardly therefrom, the roller of the upper roller assembly being captured within said channel of the upper track for rolling movement therein.

7. The shutter door assembly as set forth in claim 6 wherein the shaft of the lower roller assembly is mounted on the bottom flange of the panel and extends downwardly therefrom, the roller of the lower roller assembly being captured within said channel of the lower track for rolling movement therein.

8. The shutter door assembly as set forth in claim 4 wherein said link means comprises at least one link for connecting abutting panels, said link being attached at one of its ends to said panel roller assembly shaft and at the other end to the adjacent panel roller assembly shaft.

9. The shutter door assembly as set forth in claim 8 wherein each said link has lobes at each of its ends, each lobe having an opening formed therein sized for receiving a shaft of a roller assembly therethrough.

10. The shutter door assembly as set forth in claim 4 wherein said elongate opening of the outer hull comprises two long sides and two short ends, and wherein said upper and lower tracks extend beyond one of the ends of the opening along said inner surface of the outer wall in a direction generally parallel to said longitudinal axis, said upper and lower tracks being sloped inboard of the outer hull adjacent said one end of the opening.

11. The shutter door assembly as set forth in claim 10 wherein said drive comprises a chain encapsulated in each said lower and upper tracks, said chain being joined to at least one said panel for pulling said joined panels in a longitudinal direction to expose said outer hull opening and for pushing said joined panels in a longitudinal direction to cover said outer hull opening; said drive further comprising a drive shaft and a drive sprocket mounted on said drive shaft, and said drive sprocket engaging said chain and said roller assemblies for moving said panels between the closed and open positions.

12. The shutter door assembly as set forth in claim 11 wherein said upper and lower tracks each comprise a first track portion which extends the length of said elongate opening and beyond said end of the opening along the inner surface of the outer hull, a second track portion which extends parallel to said first track portion inboard thereof, and a curved track portion joining said first and second track portions, said drive sprocket being disposed within the arc of said curved track portion and said chain being pushed into said second track portion on moving said panels to said open position.

* * * * *